US010040526B2

(12) United States Patent
Chen et al.

(10) Patent No.: US 10,040,526 B2
(45) Date of Patent: Aug. 7, 2018

(54) DISTRESS DEVICE OF LIFEJACKET

(71) Applicant: Kerties International Co., Ltd, New Taipei (TW)

(72) Inventors: Shoei-Lai Chen, New Taipei (TW); Wen-Hsiang Cheng, New Taipei (TW)

(73) Assignee: KERTIES INTERNATIONAL CO., LTD, New Taipei (TW)

( * ) Notice: Subject to any disclaimer, the term of this patent is extended or adjusted under 35 U.S.C. 154(b) by 56 days.

(21) Appl. No.: 15/248,552

(22) Filed: Aug. 26, 2016

(65) Prior Publication Data

US 2018/0057126 A1 Mar. 1, 2018

(51) Int. Cl.
*B63C 9/11* (2006.01)
*B63C 9/20* (2006.01)
*B63C 9/00* (2006.01)

(52) U.S. Cl.
CPC ..... *B63C 9/11* (2013.01); *B63C 9/0005* (2013.01); *B63C 9/20* (2013.01)

(58) Field of Classification Search
CPC ..... B63C 9/11
USPC ..... 342/357
See application file for complete search history.

(56) References Cited

U.S. PATENT DOCUMENTS 4,305,143 A * 12/1981 Simms ..... H04B 11/00 340/573.6
6,222,484 B1 * 4/2001 Seiple ..... B63C 9/0005 342/357.55
6,545,606 B2 * 4/2003 Piri ..... B63C 9/0005 340/539.13
6,558,218 B1 * 5/2003 Hansen ..... B63C 9/01 411/35
7,053,822 B2 * 5/2006 Rickerson, Jr. ..... B63C 9/20 342/357.54
8,998,666 B1 * 4/2015 Albright ..... B63C 9/00 340/539.13
9,682,754 B2 * 6/2017 Covelli ..... B63B 45/04
2010/0295675 A1 * 11/2010 Lyon ..... B63C 9/0005 340/539.13
2014/0163664 A1 * 6/2014 Goldsmith ..... A61B 17/00491 623/1.11

* cited by examiner

*Primary Examiner* — S. Joseph Morano
*Assistant Examiner* — Jovon Hayes
(74) *Attorney, Agent, or Firm* — Chun-Ming Shih; HDLS IPR Services

(57) ABSTRACT

A distress device of lifejacket includes: a lifejacket main body; a wireless emitter, disposed inside the lifejacket main body and including a circuit board and an antenna, wherein the antenna is electrically connected to the circuit board; and a lithium polymer battery, electrically connected to the circuit board and disposed inside the lifejacket main body. Accordingly, the lithium polymer battery can be adopted to replace a convention lithium battery, so that the distress device of lifejacket can be safety disposed in an aircraft for providing sufficient amount of electricity required by the wireless emitter, thereby allowing the distress device of lifejacket to have an additional function of emitting signals, and the research and rescue team is able to rapidly locate the sufferer, so that the distress device of lifejacket is provided with advantages of increasing operation safety and facilitating the locating procedure for search and rescue.

9 Claims, 6 Drawing Sheets

DISTRESS DEVICE OF LIFEJACKET

BACKGROUND OF THE INVENTION

Field of the Invention

The present invention relates to a distress device used in a water-related field, especially to a distress device of lifejacket.

Description of Related Art

When taking an air or water transportation vehicle such as a cruiser, a yacht or an aircraft, a lifejacket is the basic safety equipment when an accident happens. When a sea disaster happens, the lifejacket is able to assist the sufferer to float on the seawater for a long period of time, so that the sufferer can be protected from being drowned and the rescue time can be prolonged.

For increasing the possibility of the sufferer in a sea disaster being rescued, the conventional lifejacket is usually painted or coated with a bright color such as yellow or orange, a light reflection strip or a light emitting bulb can also be provided, and a whistle and a light reflection mirror may also be provided, so that the sufferer in the sea disaster can be rapidly found through the noticeable appearance, lighting effect and making sounds.

However, the above-mentioned functions are still not enough for the sufferer in the sea disaster, because the bright color (yellow or orange), the light reflection strip and the light reflection mirror are unable to provide proper functions in the nighttime, the sound generated by the whistle can only be transferred to a limited distance, the conventional lithium battery is not allowed to be brought on an aircraft, and the light emitting bulb often utilizes a solar panel for storing electricity, thereby having a problem of not providing sufficient amount of electricity.

Accordingly, the applicant of the present invention has devoted himself for improving the mentioned disadvantages.

SUMMARY OF THE INVENTION

The present invention is to provide a distress device of lifejacket, in which a lithium polymer battery is adopted to replace a convention lithium battery, so that the distress device of lifejacket can be safety disposed in an aircraft for providing sufficient amount of electricity required by a wireless emitter, thereby allowing the distress device of lifejacket to have an additional function of emitting signals, and the research and rescue team is able to rapidly locate the sufferer, so that the distress device of lifejacket is provided with advantages of increasing operation safety and facilitating the locating procedure for search and rescue.

Accordingly, the present invention provides a distress device of lifejacket, which comprises: a lifejacket main body; a wireless emitter, disposed inside the lifejacket main body, wherein the wireless emitter includes a circuit board and an antenna, the antenna is electrically connected to the circuit board; and a lithium polymer battery, electrically connected to the circuit board and disposed inside the lifejacket main body.

DETAILED DESCRIPTION OF THE INVENTION

Preferred embodiments of the present invention will be described with reference to the drawings.

Figure 1:
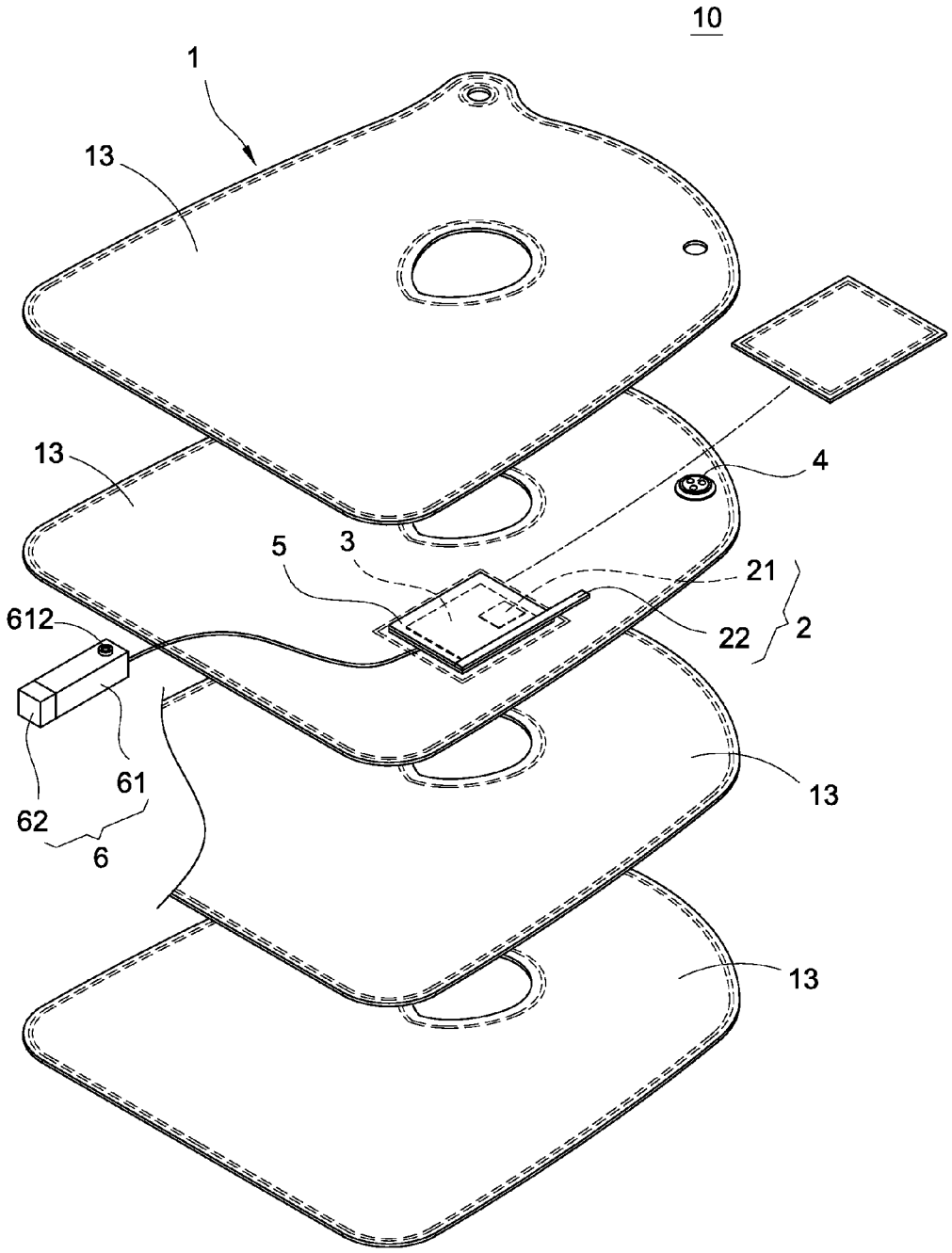
FIG. 1 is a perspective exploded view showing a distress device of lifejacket according to a first embodiment of the present invention.
Figure 2:
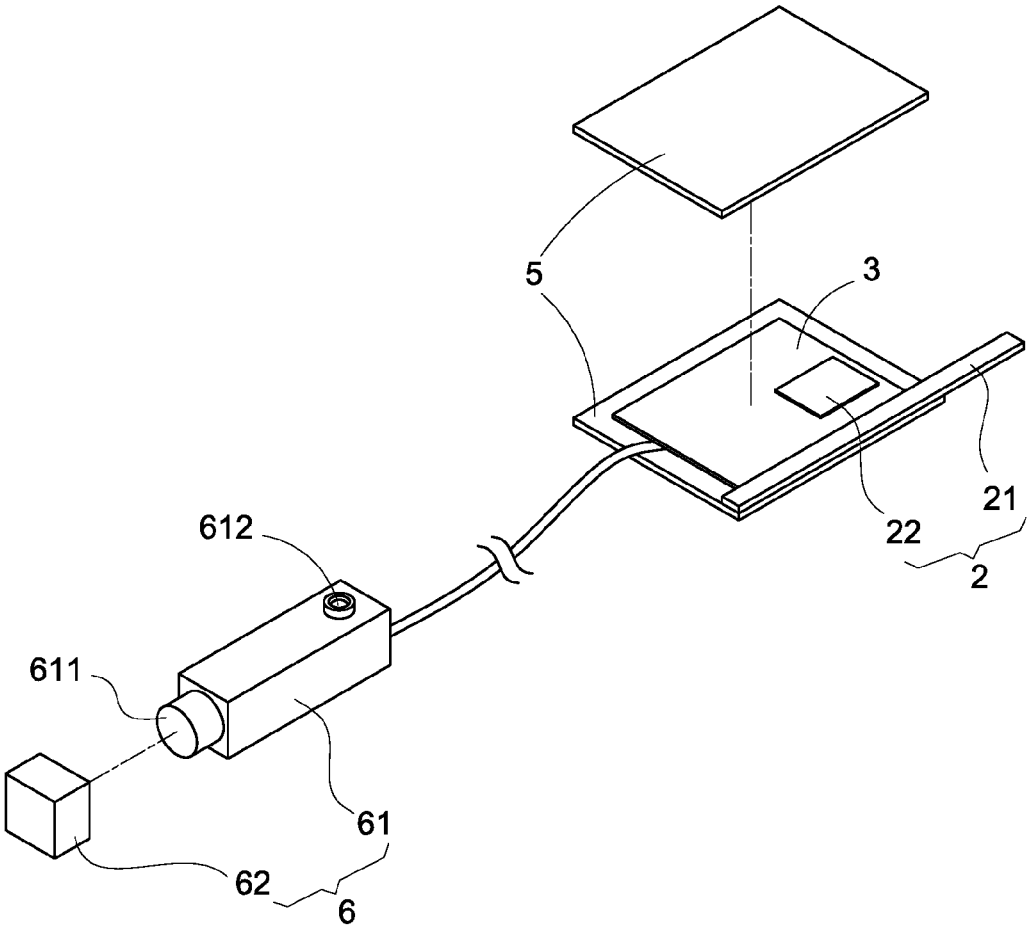
FIG. 2 is another perspective exploded view showing the distress device of lifejacket according to the first embodiment of the present invention.
Figure 3:
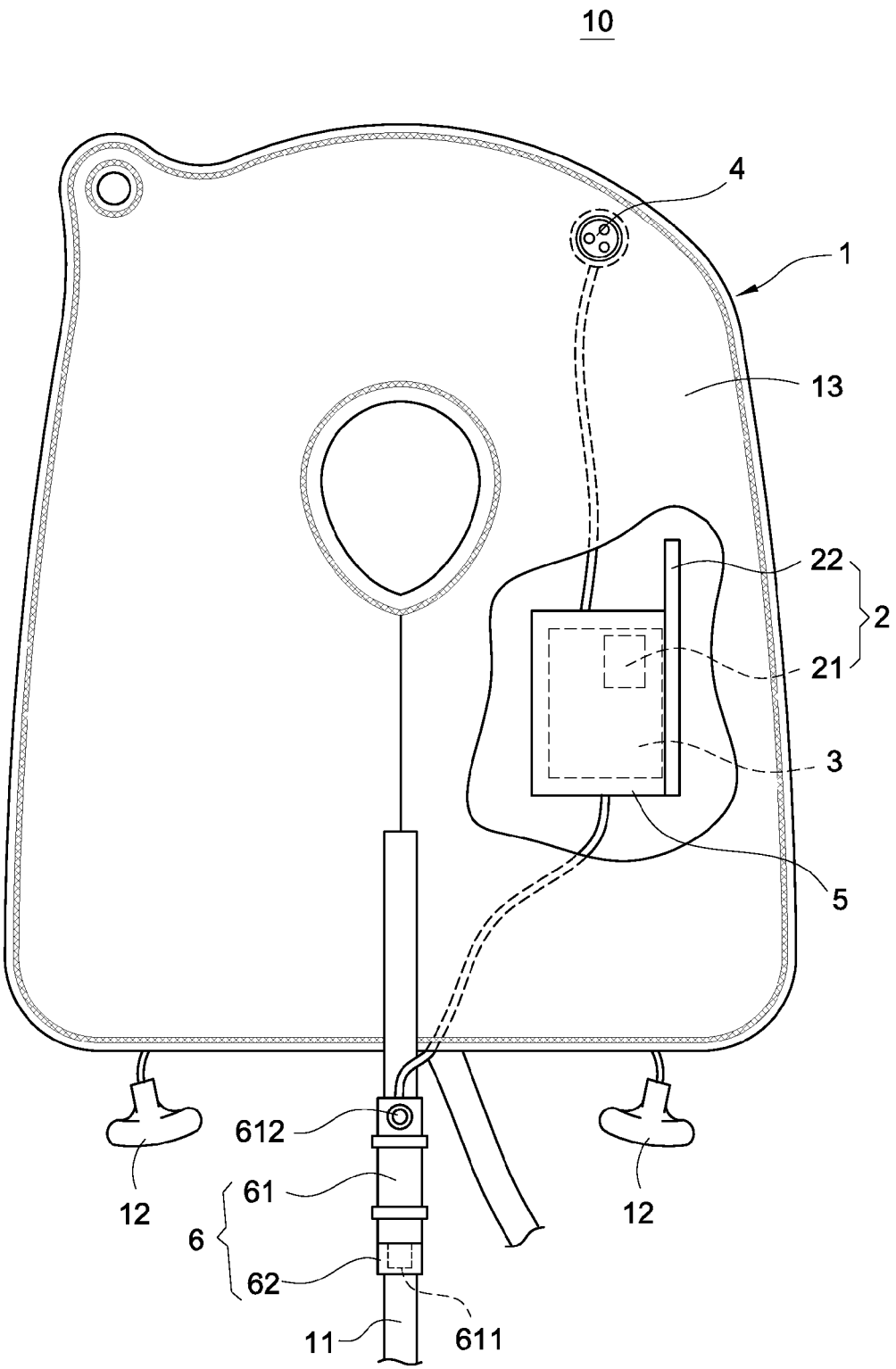
FIG. 3 is a schematic view showing the assembly of the distress device of lifejacket according to the first embodiment of the present invention.

Please refer from FIG. 1 to FIG. 3, the present invention provides a distress device of lifejacket, and the distress device of lifejacket 10 mainly comprises a lifejacket main body 1, a wireless emitter 2 and a lithium polymer battery 3.

The lifejacket main body 1 includes a tying band 11 and an inflation pulling member 12, the tying band 11 is used for tying the lifejacket main body 1 on a human body, and the inflation pulling member 12 is used for actuating a connector of an inflation steel bottle disposed therein to inflate the lifejacket main body 1 when a pulling operation is performed.

In addition, the lifejacket main body 1 is composed of at least four plastic layers 13 being mutually and thermally pressed and adhered, and the wireless emitter 2 and the lithium polymer battery 3 are disposed between two of the four plastic layers 13.

The wireless emitter 2 is disposed inside the lifejacket main body 1 and includes a circuit board 21 and an antenna 22, and the antenna 22 is electrically connected to the circuit board 21.

The lithium polymer battery 3 is defined as a lithium battery provided with polymer electrolyte, instead of liquid electrolyte, and the lithium polymer battery 3 is electrically connected to the circuit board 21 and disposed inside the lifejacket main body 1.

In addition, the liquid electrolyte contains organic solvents, so problems such as liquid leakage or even explosion may happen, the polymer electrolyte inside the lithium polymer battery 3 only contains very small amount or contains zero organic solvent, so that the lithium polymer battery 3 is provided with advantages of increasing safety, lowering the possibility of liquid leakage and preventing explosion.

Moreover, the lithium polymer battery 3 has better recharging cycles, better energy density (including mechanism energy density and weight energy density) and better battery self-discharge rate.

The distress device of lifejacket 10 provided by the present invention further includes one or a plurality of light emitting diodes 4, a package member 5 and an immersing sensor 6, the light emitting diode 4 is electrically connected to the circuit board 21, and the light emitting diode 4 is disposed and exposed on the lifejacket main body 1.

Details are provided as follows. The circuit board 21, the antenna 22 and the lithium polymer battery 3 are stacked with each other, the package member 5 is served to cover at the outer sides of the circuit board 21, the antenna 22 and the lithium polymer battery 3, so that the package member 5 is able to provide an effect of preventing moisture from entering the circuit board 21, the antenna 22 and the lithium polymer battery 3. Wherein, the package member 5 is made of epoxy or silicon.

In addition, the immersing sensor 6 is electrically connected to the circuit board 21 and exposed at the outer side of the lifejacket main body 1, the immersing sensor 6 is used for sensing water and generating a water sensing signal, and the circuit board 21 is able to receive the water sensing signal and actuate the antenna 2 to transmit a distress signal.

Moreover, the immersing sensor 6 includes a sensor body 61 and a cover member 62, the sensor body 61 includes a press switch 611 and a water sensing port 612, the sensor body 61 and the press switch 611 are respectively and electrically connected to the circuit board 21, the sensor body 61 is able to utilize the water sensing port 612 for sensing the existence of water so as to generate the water sensing signal, the cover member 62 is served to cover and shield the press switch 611, and the cover member 62 is used for protecting the press switch 611 so that the press switch 611 can be prevented from being accidently pressed.

Furthermore, according to this embodiment, the sensor body 61 is fastened on the tying band 11, thereby allowing the immersing sensor 6 to be fastened on the tying band 11, but what shall be addressed is that the scope of the present is not limited by the above-mentioned fastening means, the immersing sensor 6 can also be hanged at any location of the lifejacket main body 1.

According to the present invention, the assembly of the distress device of lifejacket 10 is that: the wireless emitter 2 is disposed inside the lifejacket main body 1 and includes the circuit board 21 and the antenna 22, and the antenna 22 is electrically connected to the circuit board 21; the lithium polymer battery 3 is electrically connected to the circuit board 21 and disposed inside the lifejacket main body 1.

According to the present invention, the operating status of the distress device of lifejacket 10 is that: the lithium polymer battery 3 is adopted to replace the conventional lithium battery, so that the distress device of lifejacket 10 can be safely placed in an aircraft and provide sufficient amount of electricity to the wireless emitter 2, thereby allowing the distress device of lifejacket 10 to be provided with an additional function of emitting signals, so when a disaster happens, sufferers wearing the lifejackets can emit a distress signal (for example: SOS, coordinates, flight information, PCS code of each lifejacket) to the COSPAS SARSAT to start the search and rescue procedure, thus the search and rescue teams are able to rapidly locate the sufferers and narrow the search range, and the whole search and rescue time can be effectively shortened; accordingly, the distress device of lifejacket 10 is provided with advantages of increasing operation safety and facilitating the locating procedure for search and rescue.

In addition, the lithium polymer battery 3 is very thin in thickness and light in weight, the volume defined by the assembly of the lithium polymer battery 3 and the wireless emitter 2 is relatively small, so that the lithium polymer battery 3, the wireless emitter 2 and the lifejacket main body 1 can be more easily combined, and the lithium polymer battery 3 can be considered as the best material for storing electricity in an aircraft.

Moreover, when a sea disaster happens, the water sensing port 612 is immersed, and the sensor body 61 is able to sense the existence of water so as to generate the water sensing signal, the circuit board 21 receives the water sensing signal and actuates the antenna 22 to emit the distress signal (for example: SOS, coordinates, flight information, PCS code of each lifejacket) to the COSPAS SARSAT (satellite-based search and rescue distress alert detection and information distribution system), thus the distress device of lifejacket 10 is provided with an advantage of having excellent accuracy for emergency search and rescue. Furthermore, the distress device of lifejacket 10 provided by the present invention further includes the light emitting diode 4, the light emitting diode 4 is exposed on the lifejacket main body 1 and can be synchronously actuated with the antenna 22, if the light emitting diode 4 cannot be lit, the sufferer can be informed that the antenna 22 is not in a normal operation status, at this moment the sufferer can manually open the cover member 62 and press the press switch 611, so that the press switch 611 is able to actuate the antenna 22 through the circuit board 21 for emitting the distress signal; accordingly, the distress device of lifejacket 10 has advantages of providing lights at nighttime and ensuring the normal operation status of the antenna 22.

Figure 4:
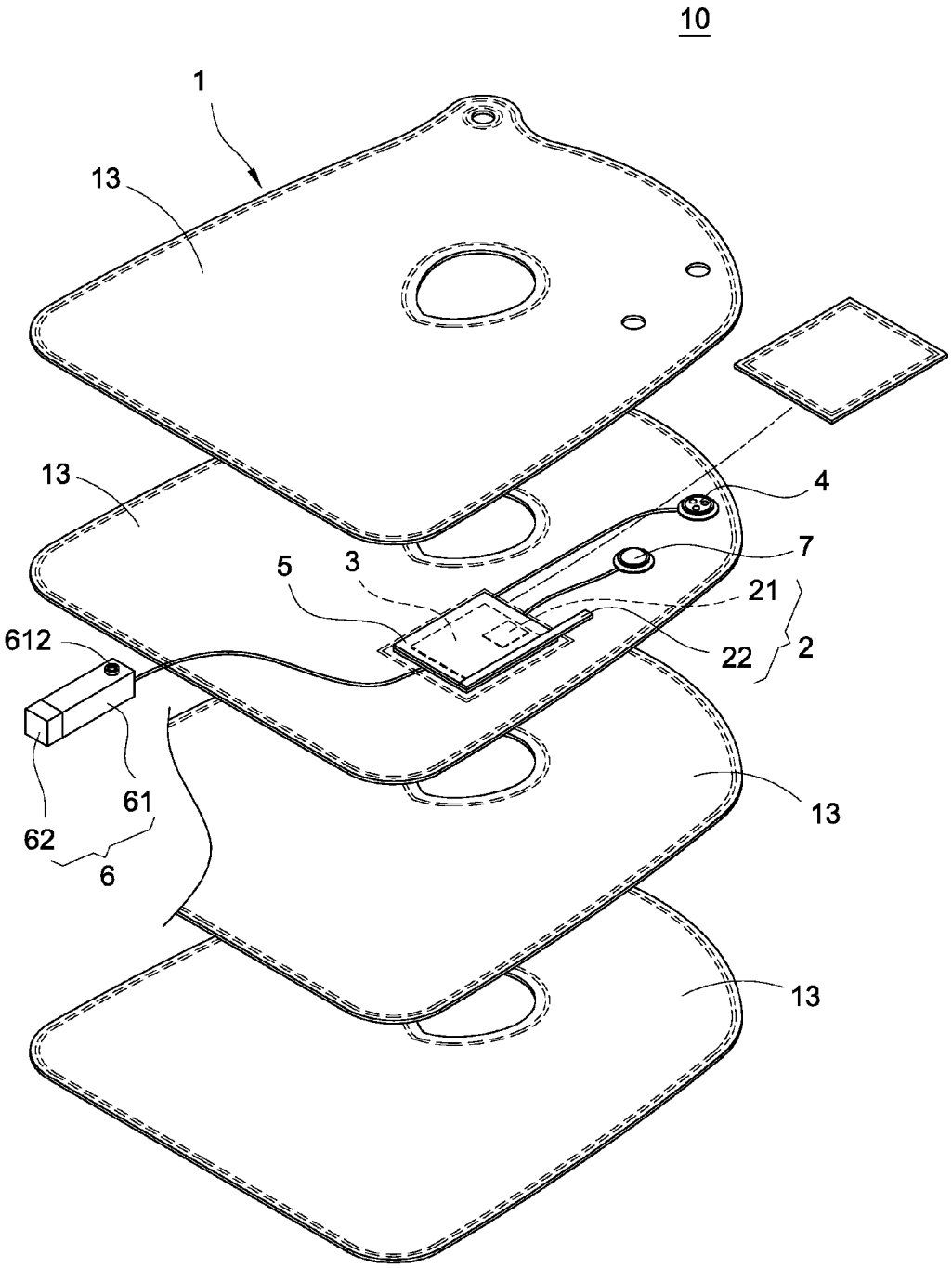
FIG. 4 is a perspective exploded view showing the distress device of lifejacket according to a second embodiment of the present invention.
Figure 5:
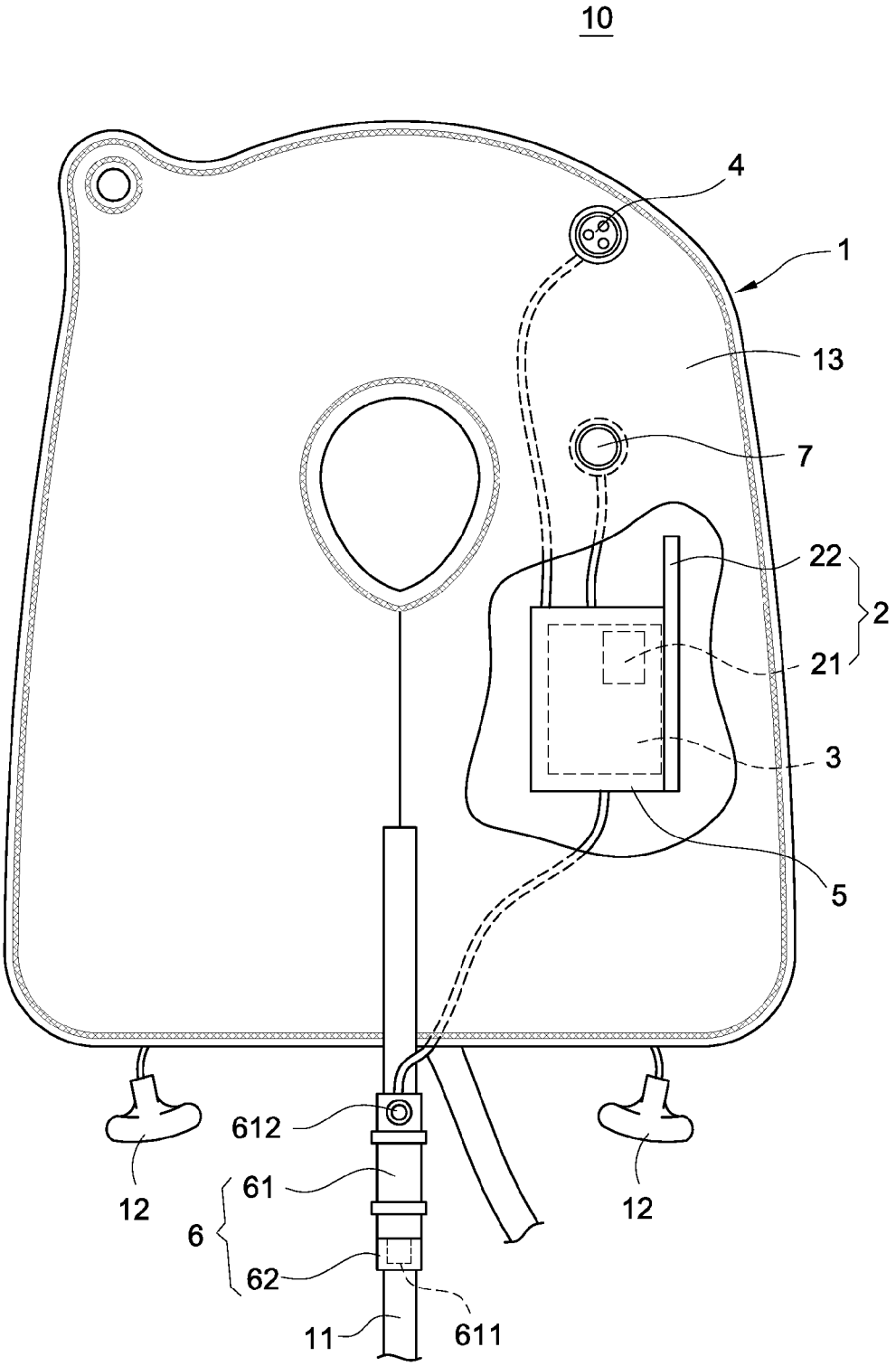
FIG. 5 is a schematic view showing the assembly of the distress device of lifejacket according to the second embodiment of the present invention.

Please refer to FIG. 4 and FIG. 5, which disclose a second embodiment of the distress device of lifejacket 10 provided by the present invention. The second embodiment is substantially the same as the first embodiment, and the difference between the second embodiment and the first embodiment is that the distress device of lifejacket 10 further includes a switch member 7.

Details are provided as follows. The switch member 7 is disposed and exposed on the lifejacket main body 1, the switch member 7 is electrically connected to the circuit board 21, and the switch member 7 is able to actuate the antenna 22 through the circuit board 21 for emitting the distress signal. Accordingly, the sufferer can press the switch member 7 to actuate the antenna 2 for emitting the distress signal (for example: SOS, coordinates, flight information, PCS code of each lifejacket) to the COSPAS SARSAT, thus the distress device of lifejacket 10 is provided with an advantage of ensuring the wireless emitter 2 being actually actuated.

Figure 6:
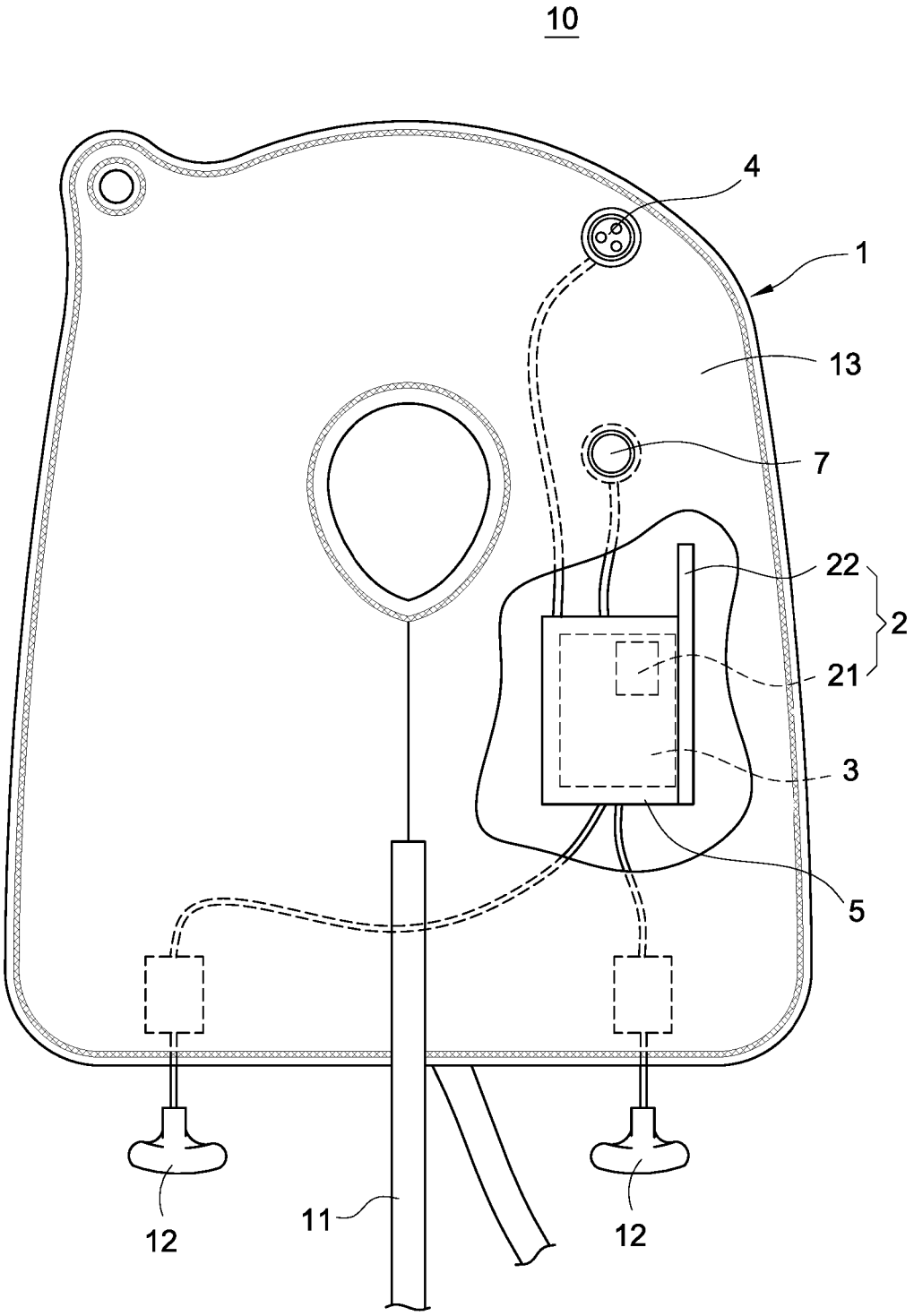
FIG. 6 is a schematic view showing the assembly of the distress device of lifejacket according to a third embodiment of the present invention.

Please refer to FIG. 6, which disclose a third embodiment of the distress device of lifejacket 10 provided by the present invention. The third embodiment is substantially the same as the first embodiment, and the difference between the third embodiment and the first embodiment is that the inflation pulling member 12 is electrically connected to the circuit board 21.

Details are provided as follows. Because the inflation pulling member 12 is electrically connected to the circuit board 21, when the inflation pulling member 12 is pulled, the circuit board 21 is triggered to actuate the antenna 22 for emitting the distress signal. Accordingly, when the lifejacket main body 1 is inflated for being used, the inflation pulling member 12 is pulled and the antenna 22 is actuated at the same time for emitting the distress signal (for example: SOS, coordinates, flight information, PCS code of each lifejacket) to the COSPAS SARSAT, so that the distress device of lifejacket 10 of the present invention is provided with an advantage of having excellent accuracy for emergency search and rescue.

Although the present invention has been described with reference to the foregoing preferred embodiment, it will be understood that the invention is not limited to the details thereof. Various equivalent variations and modifications can still occur to those skilled in this art in view of the teachings of the present invention. Thus, all such variations and equivalent modifications are also embraced within the scope of the invention as defined in the appended claims.

What is claimed is:

1. A distress device of lifejacket, comprising:

a lifejacket main body;

a wireless emitter, disposed inside the lifejacket main body and including a circuit board and an antenna, wherein the antenna is electrically connected to the circuit board; and a lithium polymer battery, electrically connected to the circuit board and disposed inside the lifejacket main body, wherein the lifejacket main body is composed of at least four plastic layers being mutually and thermally pressed and adhered, and the wireless emitter and the lithium polymer battery are disposed between two of the four plastic layers.

2. The distress device of lifejacket according to claim 1, further including at least one light emitting diode, the light emitting diode is disposed and exposed on the lifejacket main body and electrically connected to the circuit board.

3. The distress device of lifejacket according to claim 1, further including a package member, the circuit board, the antenna and the lithium polymer battery are stacked with each other, the package member is served to cover at outer sides of the circuit board, the antenna and the lithium polymer battery, and the package member is made of epoxy or silicon.

4. The distress device of lifejacket according to claim 1, further including an immersing sensor, the immersing sensor is electrically connected to the circuit board and exposed at an outer side of the lifejacket main body, the immersing sensor is used for sensing water and generating a water sensing signal, and the circuit board is able to receive the water sensing signal and actuate the antenna to transmit a distress signal.

5. The distress device of lifejacket according to claim 4, wherein the immersing sensor includes a sensor body, the sensor body is electrically connected to the circuit board and includes a water sensing port, and the sensor body is able to utilize the water sensing port for sensing the existence of water.

6. The distress device of lifejacket according to claim 4, wherein the lifejacket main body includes a tying band, and the immersing sensor is fastened on the tying band.

7. The distress device of lifejacket according to claim 4, wherein the immersing sensor includes a sensor body and a cover member, the sensor body includes a press switch, the sensor body and the press switch are respectively and electrically connected to the circuit board, and the cover member is served to cover and shield the press switch.

8. The distress device of lifejacket according to claim 1, further including a switch member, the switch member is disposed and exposed on the lifejacket main body and electrically connected to the circuit board, and the switch member is able to actuate the antenna through the circuit board for emitting a distress signal.

9. The distress device of lifejacket according to claim 1, wherein the lifejacket main body includes an inflation pulling member, the inflation pulling member is electrically connected to the circuit board, and when the inflation pulling member is pulled, the circuit board is triggered to actuate the antenna for emitting a distress signal.

* * * * *